United States Patent [19]

Richards

[11] 4,445,610

[45] May 1, 1984

[54] PACKAGE OF RAZORS

[75] Inventor: Richard D. Richards, Liphook, England

[73] Assignee: Wilkinson Sword Limited, England

[21] Appl. No.: 365,740

[22] Filed: Apr. 5, 1982

[30] Foreign Application Priority Data

Apr. 11, 1981 [GB] United Kingdom ..... 8111470
Jun. 12, 1981 [GB] United Kingdom ..... 8118174

[51] Int. Cl.[3] ..... B65D 85/62; B65D 5/04; B65D 5/44; A45D 27/29

[52] U.S. Cl. ..... 206/349; 206/45.14; 206/354; 206/443; 206/486

[58] Field of Search ..... 206/354, 443, 45.14, 206/349, 372, 373, 485, 486

[56] References Cited

U.S. PATENT DOCUMENTS

| | | | |
|---|---|---|---|
| 4,153,162 | 5/1979 | Samsing | 206/372 |
| 4,266,664 | 5/1981 | Dixon et al. | 206/485 |
| 4,319,680 | 3/1982 | Heimstra | 206/499 |

*Primary Examiner*—William T. Dixson, Jr.
*Attorney, Agent, or Firm*—John K. Williamson

[57] ABSTRACT

The pack is folded from a card having a generally rectangular panel forming the front of the pack joined to a generally rectangular panel forming the back of the pack via a spine. The edges of the panel, remote from the spine are adhered together, if necessary with the assistance of a flap, to lock the staggered stack of razors within a slot in the edge of the panel, the back panel of the pack having one or more cut-outs or flaps with which portions of the razor handles engage thereby holding the handles in position.

11 Claims, 10 Drawing Figures

PACKAGE OF RAZORS

BACKGROUND OF THE INVENTION

This invention relates to a pack for razors, in particular disposable razors. Such packs are sometimes called sales or display packs or display cards. A disposable razor is one comprising a handle, usually of a plastics material, and a blade unit containing one or more blades and forming the head of the razor, both the handle and the blade unit being discarded by the user when he finds that the razor is no longer giving a satisfactory shave. The invention also concerns a foldable card for supporting the razors.

A requirement exists for a display pack for razors which takes up very little space on a display rack, which holds the razors securely and which is economic to produce and to assemble.

BRIEF SUMMARY OF THE INVENTION

According to the invention there is provided a pack for razors comprising a first panel for forming one side of the pack and having a slot therein for receiving part of each handle of a stack of razors arranged in a side-by-side staggered array, and for supporting the heads of the razors, and a second panel secured along one side thereof to one side of the first panel for forming the opposite side of the pack, and adapted to be secured along its opposite side to the adjacent side of the first panel to close the pack and extend across the handles of the razors so that the handles are held between the two panels, and means being provided on at least one of said panels to limit the lateral movement of said handles.

BRIEF DESCRIPTION OF THE DRAWINGS

The construction of a pack in accordance with the invention will now be described by way of example with reference to the accompanying drawings in which.

DETAILED DESCRIPTION

Figure 3:
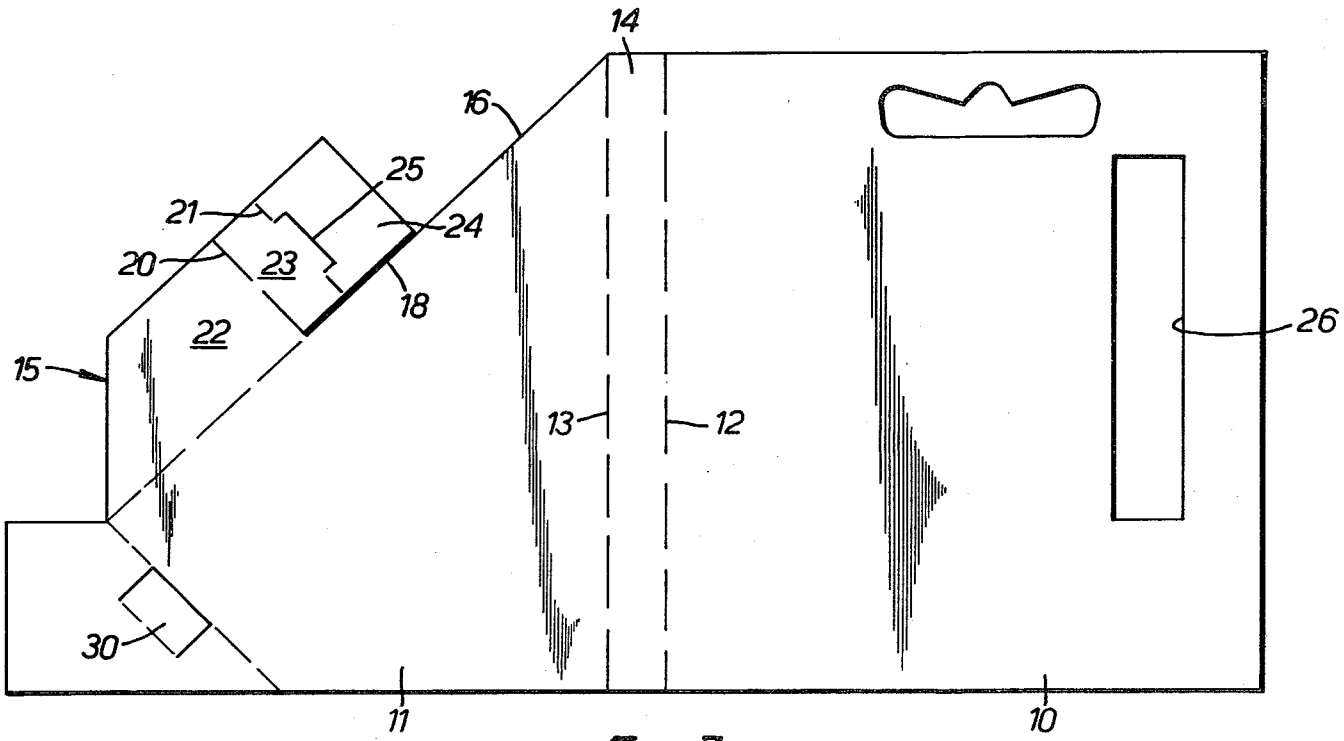
FIG. 3 is a plan view of a card from which the pack of FIG. 1 and FIG. 2 has been assembled.

The card of FIG. 3 comprises a rectangular portion or panel 10 for forming the front of the pack, and a roughly triangular portion or panel 11 for forming the back of the pack and separated by two parallel spaced fold lines 12, 13 from the front panel. The lines 12, 13 are spaced apart by a distance corresponding to the thickness of a razor handle to form a spine 14 securing the front and back panels of the folded card to each other, but in spaced apart relationship.

A flap 15 is formed to project outwardly of the slanting side 16 of the card panel 11, the flap being connected to panel 11 over about half of its length. The remainder of the flap is separated from card panel 11 by a slit 18.

The slit 18 extends along the direction of side 16 up to a fold line 20 on flap 15, line 20 being perpendicular to line 16. A second fold line 21 is provided on flap 15, and these fold lines 20, 21 divide the flap 15 into three panels 22, 23, 24. The fold lines permit the flap 15 to be folded to a three-sided box shape about lines 20 and 21. A three-sided slit is formed adjacent fold line 21 to define a tongue 25 which remains in the plane of panel 23 when the panels 23 and 24 have been folded through 90° about lines 20 and 21 respectively.

The front-forming panel 10 of the card is formed with an elongate slot 26 to receive the handles 27 of an assembly of razors (five razors in the embodiment illustrated) the slot being formed adjacent the side of the card panel 10 which is remote from the spine 14.

Figure 1:
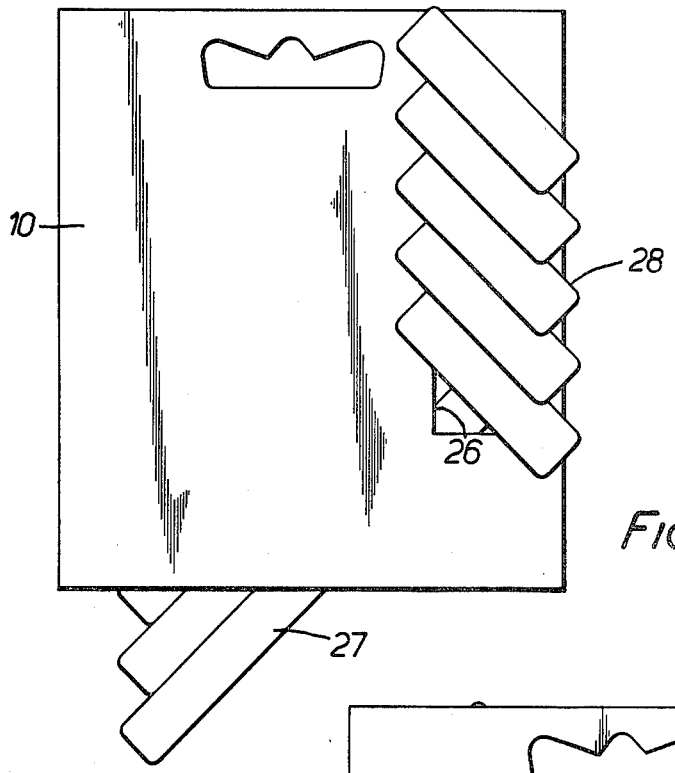
FIG. 1 is a front view of a display pack containing five disposable razors, the razors being shown only in outline.
Figure 2:
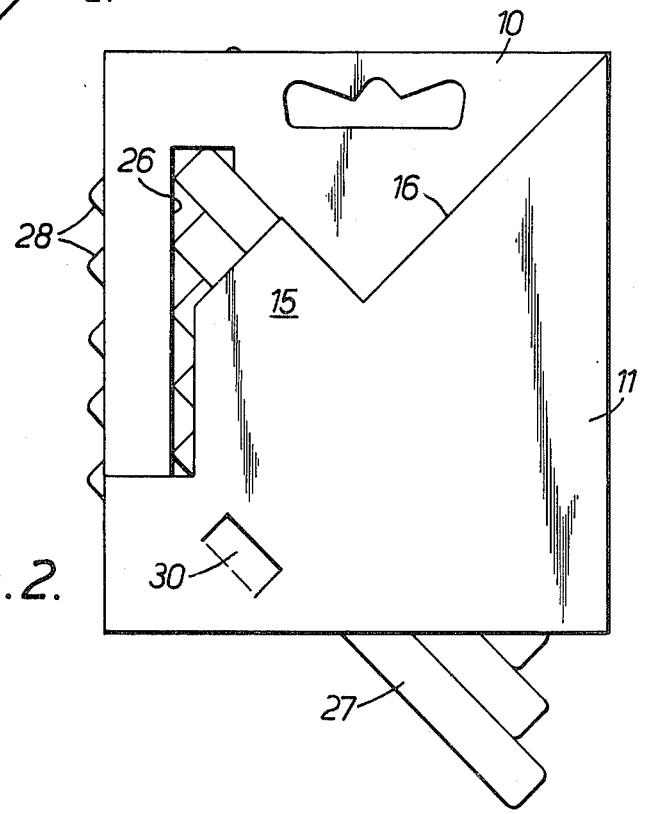
FIG. 2 is a rear view of the pack of FIG. 1.

In assembling the pack, the razors are stacked in a side-by-side staggered array with the blade units or razor heads 28 overlapping one another as shown in FIG. 1. The handles 27 of the assembly of razors are then fitted through the slot 26 until the razor heads 28 abut against the card. The handles are arranged to extend obliquely across the rear side of card panel 10, and in practice some of the handles will overlap the lower edge of the card panel 10 as seen in FIG. 1.

The panels 23, 24 of flap 15 are then folded about fold line 20 and card panel 11 is folded about fold lines 12, 13 until the card panel 11 lies parallel to card panel 10, sandwiching the razor handles therebetween. At the same time flap panel 24 is folded about line 21 and tucked behind the razor handles 27 to lie in contact with card panel 10. Thus, the outer side of the uppermost razor in the stack is prevented from outward lateral movement by engagement with panel 23. The parts of the card seen at the extreme right and left hand bottom corners in FIG. 3 are stapled or adhered to each other to hold the pack closed. The free edge of tongue 25 frictionally engages the rear of card panel 10 and assists in holding the box shaped-flap 15 in position.

In order to prevent lateral movement of the razor handles in the opposite direction, a flap 30 formed by a three-sided slit in panel 11 is pushed inwardly toward card panel 10 to form a stop capable of engaging and supporting the lowermost handle of the stack of razors.

Figure 4:
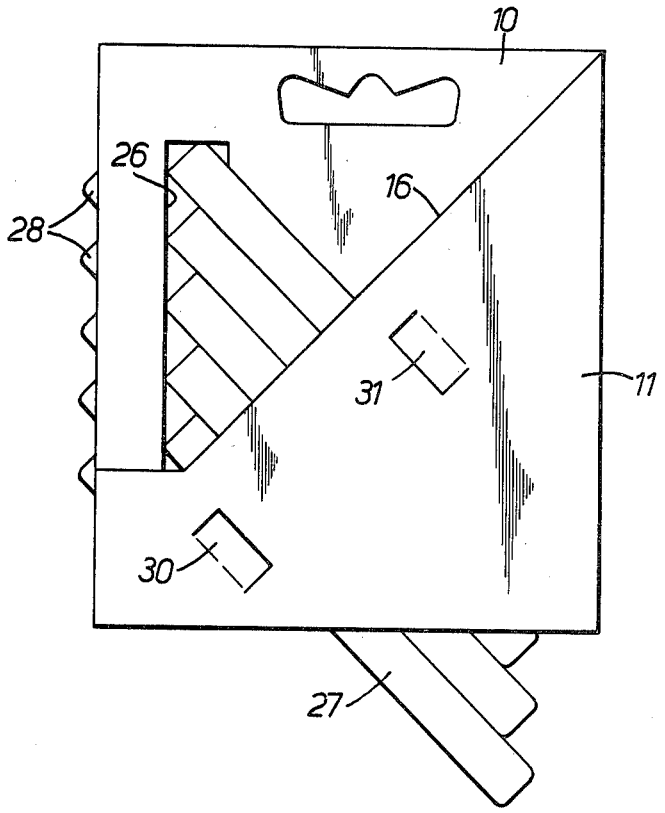
FIG. 4 is a view, corresponding to that of FIG. 2, of a modified display pack.

In the modification illustrated in FIG. 4, the flap 15 is omitted, and replaced by a flap 31 formed by a three-sided slit formed in panel 11. The flaps 30, 31 are complementary and, when pushed inwardly, form stops serving to contact and support the outermost two razors of the pack and hence to support the stack of razors.

Although the flaps 30, 31 have been shown and described as being in the back panel 11 of the card, it will be evident that they could alternatively be provided in the front panel 10 of the card, or one flap could be in one panel and the other flap in the other panel.

Figure 7:
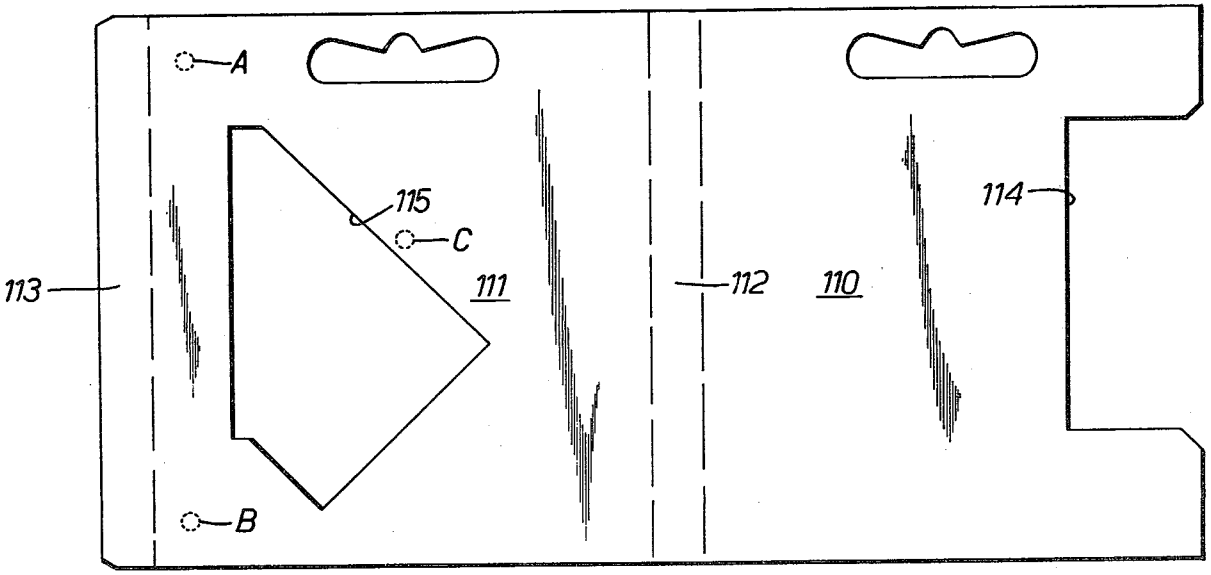
FIG. 7 is a plan view of a card from which the pack of FIG. 5 and FIG. 6 has been folded.

The card of FIG. 7 comprises a generally rectangular portion for forming the front panel 110 of the pack, a generally rectangular portion for forming the back panel 111 of the pack, the front and back panels being connected by a rectangular spine 112 for forming a spacer between the front and back panels. A flap 113 is formed on the edge of the panel 111 remote from the spine 112.

Figure 5:
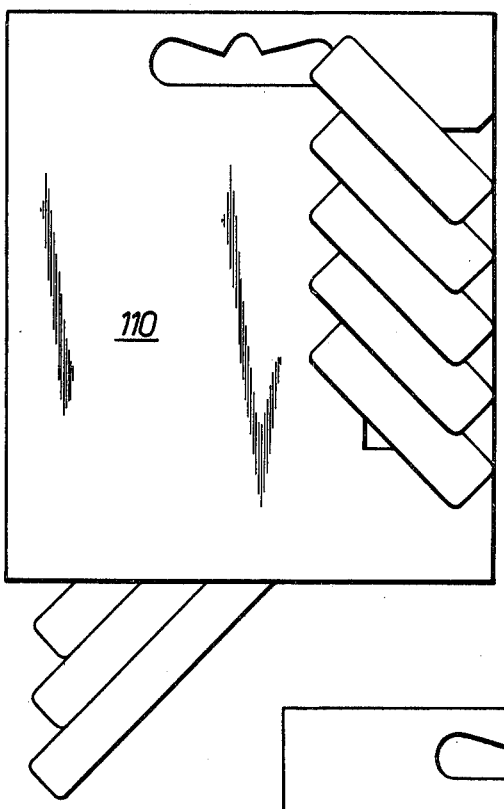
FIG. 5 is a front view of another form of display pack containing five disposable razors.
Figure 6:
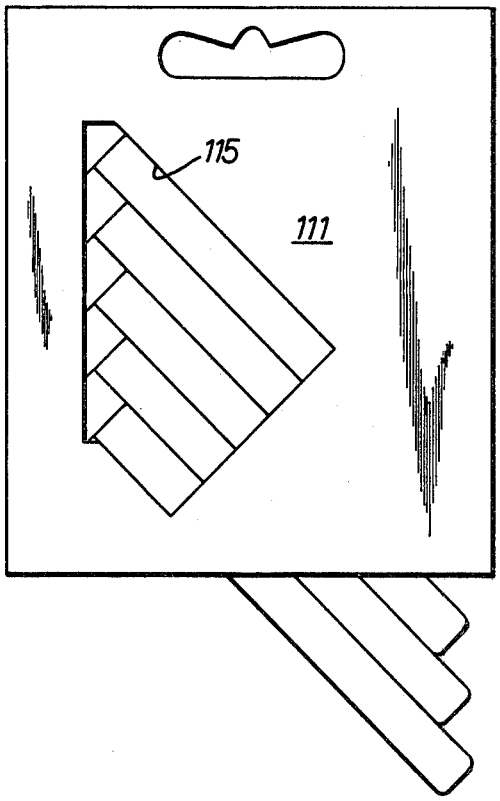
FIG. 6 is a rear view of the pack of FIG. 5.

The front of the pack is provided, along its righthand edge as shown in FIG. 7 with a rectangular slot 114 which opens on to the right hand edge and into which a stack of five razors can be fitted, with the handles of the razors lying in side-by-side abutment with each other and the heads of the razors overlapping each other in a staggered or chevron array as seen in FIGS. 5 and 6.

The back panel 111 of the pack is provided with a trapezoidal-shaped opening 115 defined between two parallel-spaced edges 115*a*, 115*b* on the card which, in the assembled pack, are aligned with the outer sides of the handles of the outermost razors in the stack. This opening is designed, when the pack has been folded to the shape shown in FIGS. 5 and 6, to receive the back portions of the razor handles. As a result of the wedge-shaped cross-section of the back, these back portions of the handles project through the opening and the opposite edges of the opening to prevent lateral movement of the handles.

Figure 10:
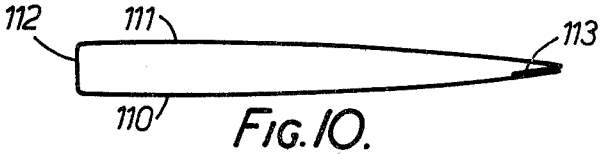

This card is adapted to be folded and assembled to form a pack by machine operation. In the operation of folding of the card, glue is applied to the front face of back panel 111 at the three positions marked A, B, and C and along the flap 113, the flap 113 is then bent through 180° into abutment with the back panel 111 of the pack, the spine 112 is bent through 90° to place it perpendicular to the front forming panel 110 of the pack, the back panel 111 is bent through 90° relative to the spine 112 to bring it into engagement with the handles of the razors, and the overlapping portions of the flap 113, the back panel 111 and the front panel 110 of the card are glued together to cloxse the slot 114 and lock the razors within the pack. As seen in FIGS. 5 and 6, the heads of the razors overlie the portions of front panel 110 on opposite sides of the recess 114, and are supported by the front panel 110. Due to the wedge-shaped crosssection of the pack seen in FIG. 10 the back portions of the handles adjacent the razor heads are received in and located by the parallel edges 115*a*, 115*b* of the opening 115, whereas the free ends of the handles lie between the front and back panels 110, 111 of the pack close to the spine 112 and will project from the open lower end of the pack. Again, the wedge shape of the folded card assists in holding the razor handles in position.

In a modification of the illustrated card, the flap 113 can be omitted if the card is otherwise of adequate strength to support the number of razors to be packed.

Figure 8:
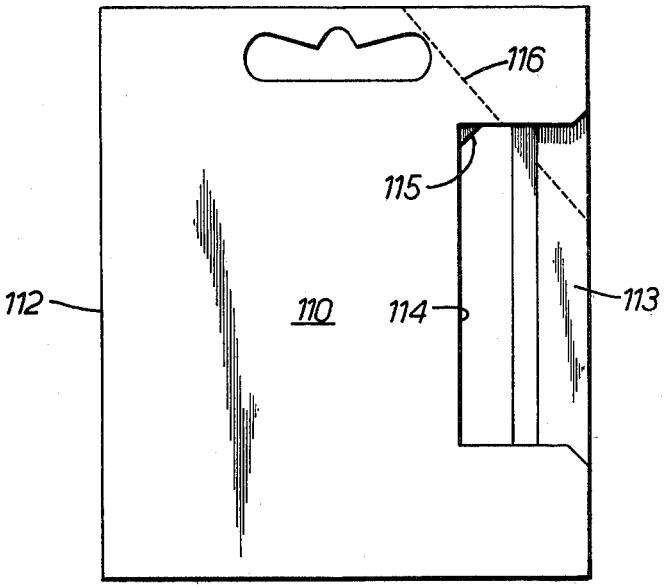
FIGS. 8, 9 and 10 are respectively a front view, a rear view, and a view from above of the card of FIG. 7 which has been folded without the razors being included.
Figure 9:
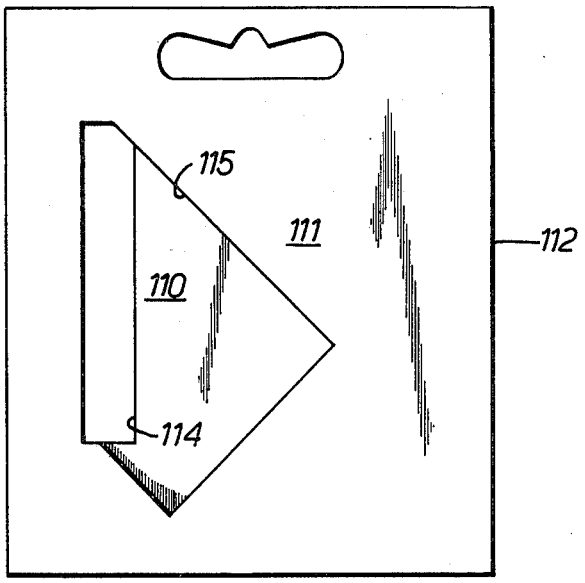

If desired, a foldline 116 can be formed across the top right-hand corner of the pack as seen in FIG. 8 so that, by folding the corner of the pack along the foldine 116, the top-most razor can be withdrawn leaving the remaining razors in position in the pack.

I claim:

1. A package of razors including a pack, and a nested stack of razors retained within said pack in a side-by-side staggered array, said pack comprising a first panel for forming one side of the pack and having a slot therein for receiving part of each handle of said stack of razors, and for supporting the heads of the razors, and a second panel secured along one side thereof to one side of the first panel for forming the opposite side of the pack, and adapted to be secured along its opposite side to the adjacent side of the first panel to close the pack and extend across the handles of the razors so that the handles are held between the two panels, and means being provided on at least one of said panels to limit the lateral movement of said handles.

2. A package according to claim 1 wherein the second panel is formed with an opening, the opening having two opposite edges which are aligned with the outer sides of the outermost razor handles of the stack of razors such that, in the assembled pack, the stack of handles projects into the opening and the said edges form abutments which constitute said means to limit the lateral movement of the handles.

3. A package according to claim 1 wherein said slot opens on to one edge of the first panel, and the second panel carries a flap for engagement with said adjacent side of the first panel to close said slot.

4. A package according to claim 1 wherein a spine interconnects the first and second panels the spine having a width corresponding to the depth of a handle of said razors.

5. A package according to claim 1 wherein the first panel is of substantially rectangular shape and the second panel is of substantially triangular shape and connected along one side thereof to one side of the first panel remote from said slot.

6. A package according to claim 1 wherein flaps can be folded out of at least one of the panels to form said means for limiting lateral movement of said handles.

7. A package according to claim 1 wherein the second panel has a flap attached thereto a part of which can be folded to engage the first panel and to form said means for limiting lateral movement of said handles.

8. A package according to claim 7 wherein the second panel has a portion which can be bent out of the plane of the second panel to form a stop, said stop and said flap cooperating to limit lateral movement of the razor handles in opposite directions.

9. A package according to claim 1 wherein one of said panels has two flaps, each formed by a three-sided slit in said one panel, said flaps being bendable out of the plane of said one panel to form stops for engaging the outer sides of the outermost razors of the stack and constitute said means for limiting lateral movement of the handles.

10. A package of razors having a pack, and a stack of razors assembled in a side-by-side staggered array within said pack, each razor having a handle and a head attached to said handle, the pack having front and back panels held together to define a space therebetween in which the handles of the stack of razors are received, the heads of the razors being arranged on the front of the panel, the handles extending from the heads through a slot in the front panel, and means on at least one of the panels which engage the outermost handles of the stack and limit lateral movement of the handles.

11. A package according to claim 10, wherein the pack is rectangular and is closed on two opposite sides and open on the other two opposite sides, the outer ends of the razor handles lying in or adjacent one of said open sides of the pack.

* * * * *